US005927710A

United States Patent [19]

Pollich et al.

[11] Patent Number: 5,927,710

[45] Date of Patent: Jul. 27, 1999

[54] DEVICE FOR MANIPULATING STACKS FORMED OF SHEETS

[75] Inventors: Gerhard Pollich, Heidelberg; Peter Gamperling, Bammental; Ralf Steinmetz, Edingen, all of Germany

[73] Assignee: Heidelberger Druckmaschinen AG, Heidelberg, Germany

[21] Appl. No.: 08/979,536

[22] Filed: Nov. 26, 1997

[30] Foreign Application Priority Data

Nov. 28, 1996 [DE] Germany ..... 196 49 319

[51] Int. Cl.[6] ..... B65H 31/32

[52] U.S. Cl. ..... 271/218; 414/790.8

[58] Field of Search ..... 271/158, 218; 414/790, 790.8

[56] References Cited

U.S. PATENT DOCUMENTS

| | | | |
|---|---|---|---|
| 2,684,242 | 7/1954 | Schmidt et al. . | |
| 3,180,638 | 4/1965 | Meylan . | |
| 3,285,607 | 11/1966 | Lindemann . | |
| 3,951,401 | 4/1976 | Marass | 271/158 |
| 4,799,847 | 1/1989 | Bodewein | 414/790.8 |
| 5,060,929 | 10/1991 | Kohlmann | 271/218 |

FOREIGN PATENT DOCUMENTS 1265162 4/1968 Germany .

*Primary Examiner*—Janice L. Krizek

*Attorney, Agent, or Firm*—Herbert L. Lerner; Laurence A. Greenberg

[57] ABSTRACT

A device for manipulating stacks formed of sheets for a rotary printing press by which the sheets are processable in a processing direction in a so-called nonstop operation, the device including an auxiliary stack support having a cantilevered end and being disposed in an operating position thereof so as to catch the sheets from below, and a carrier carrying the auxiliary stack support so that it is displaceable in and counter to the processing direction, includes a bearing carried by the carrier for supporting at an operating level the cantilevered end of the auxiliary stack support disposed in the operating position thereof, the bearing being adjustable between a functional position into which it has been lowered below the operating level and a functional position wherein it supports the cantilevered end at the operating level.

4 Claims, 6 Drawing Sheets

DEVICE FOR MANIPULATING STACKS FORMED OF SHEETS

BACKGROUND OF THE INVENTION

Field of the Invention

The invention relates to a device for manipulating stacks formed of sheets for a rotary printing press by which the sheets are processable in one processing direction in a so-called nonstop operation, the device including an auxiliary stack support having a cantilevered end and being disposed in an operating position thereof so as to catch the sheets from below, and a carrier carrying the auxiliary stack support so that it is displaceable in and counter to the processing direction, the carrier having a bearing for supporting at an operating level the cantilevered end of the auxiliary stack support disposed in the operating position thereof.

A stack-manipulating device of this general type has become known heretofore from U.S. Pat. No. 3,180,638, for example. The auxiliary stack support thereof is formed like a rake and is installed for the purpose of temporarily carrying a stack which has become nearly exhausted until that stack is combined with a new stack. To ensure that the cantilevered ends of the tines of the rake, in the operating position of the latter, will be supported on a bearing, the heights at which the tines of the rake, on the one hand, and the bearing, on the other hand, are disposed must be adapted or matched to one another. This adaptation can be impaired, however, for example, if the tines of the rake deviate even slightly from an ideal, straight shape.

It is accordingly an object of the invention to provide a stack-manipulating device of the foregoing general type described in the introduction hereto wherein support of the cantilevered end of the auxiliary stack support on the bearing is achievable even if the auxiliary stack support has defects in form which impair the adaptation or matching of the heights of the auxiliary stack support and the bearing relative to one another.

SUMMARY OF THE INVENTION

This object is attained in accordance with the invention in that the bearing is adjustable between a functional position lowered below the operating or work level and a functional position that supports the cantilevered end at the operating or work level.

With the foregoing and other objects in view, there is provided, in accordance with the invention, a device for manipulating stacks formed of sheets for a rotary printing press by which the sheets are processable in a processing direction in a so-called nonstop operation, the device including an auxiliary stack support having a cantilevered end and being disposed in an operating position thereof so as to catch the sheets from below, and a carrier carrying the auxiliary stack support so that it is displaceable in and counter to the processing direction, comprising a bearing carried by the carrier for supporting at an operating level the cantilevered end of the auxiliary stack support disposed in the operating position thereof, the bearing being adjustable between a functional position into which it has been lowered below the operating level and a functional position wherein it supports the cantilevered end at the operating level.

In accordance with another feature of the invention, the device includes a base for adjustably receiving the bearing thereon between the functional positions thereof, the base being displaceable relative to the carrier in and counter to the processing direction between two end positions.

In accordance with a further feature of the invention, the device includes a linkage encompassing the bearing, and an actuator operatively engaging the linkage.

In accordance with a concomitant feature of the invention, the device includes a base for supporting the bearing carried by the carrier and arranged so as to be displaceable relative to the carrier in and counter to the processing direction between two end positions, and an articulated connection of the bearing to the base, the articulated connection having at least one horizontal pivot axis directed crosswise to the processing direction, a positioner assembly engaging the base for displacing the base between the two end positions, and a stop for supporting the bearing in a respective one of the two end positions in a respective one of the two functional positions thereof.

The opportunity is thereby created of first placing the bearing below the operating level, then displacing the auxiliary stack support into the operating position thereof and finally lifting the bearing to the operating level thereof. Assurance can thereby be provided that the auxiliary stack support is displaceable into the operating position thereof without hindrance, that is, the displacement is not hindered, for example, by the cantilevered end of the auxiliary stack support striking the bearing before reaching the operating position thereof. Moreover, the auxiliary stack support can be prevented from moving under the bearing, and thus the support of the cantilevered end by the bearing is always assured.

The subject of the invention can be employed both in the delivery and in the feeder of the rotary printing press.

Other features which are considered as characteristic for the invention are set forth in the appended claims.

Although the invention is illustrated and described herein as embodied in a device for manipulating stacks formed of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
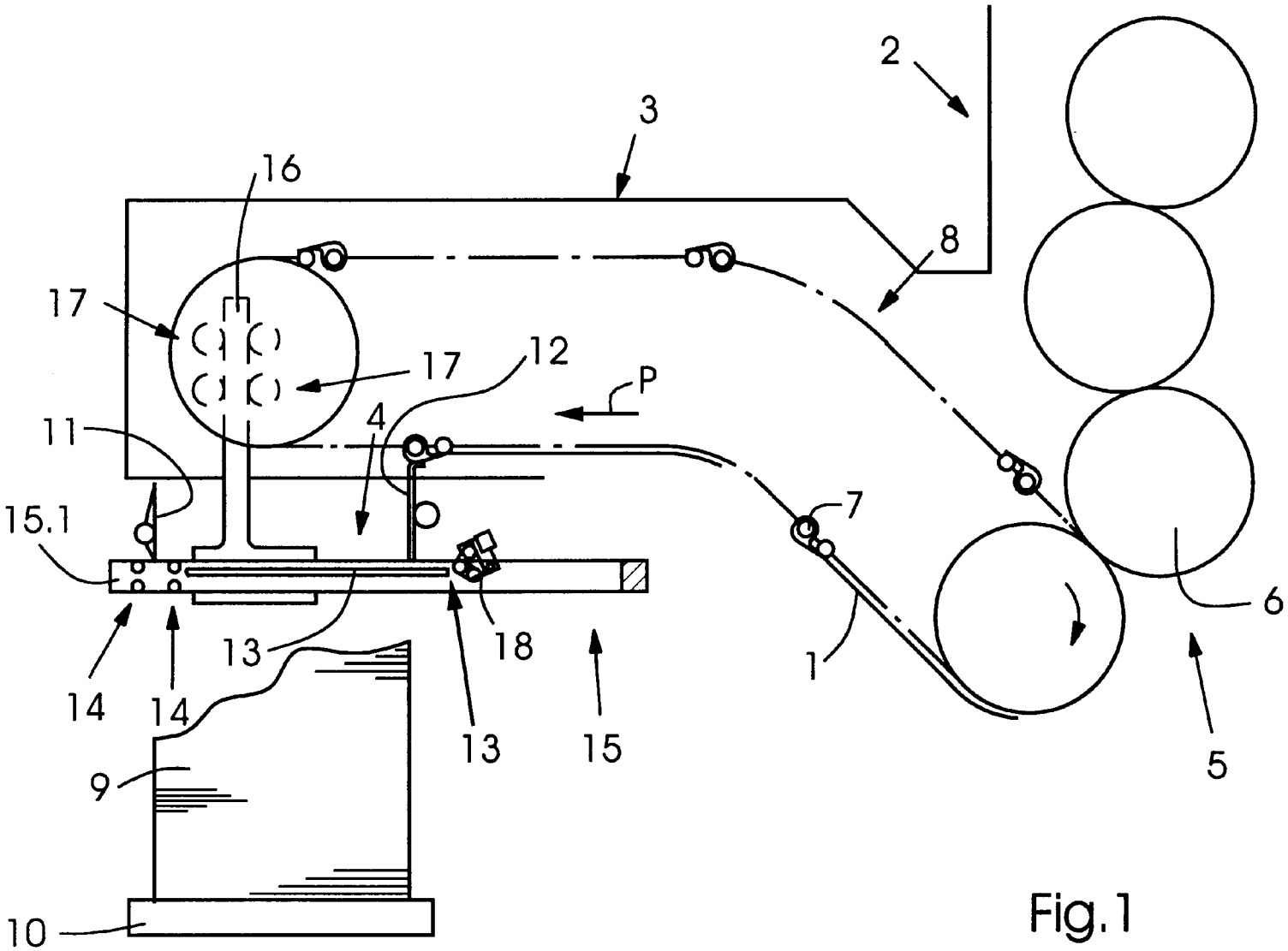
FIG. 1 is a diagrammatic fragmentary side elevational view of a rotary printing press including a delivery with an exemplary embodiment of the device for manipulating stacks of sheets according to the invention, shown in greatly simplified fashion.

Referring now to the drawing and, first, particularly to FIG. 1 thereof, there is shown therein how, in a nonstop operating mode of a rotary printing press 2 which processes sheets 1, the press feeds an uninterrupted stream of sheets through the intermediary of a delivery 3 into a delivery stack or pile space 4. A part of the rotary printing press which includes the delivery 3 is shown greatly simplified in FIG. 1. By way of example, the rotary printing press 2 is equipped with a printing unit 5 operating by the offset process and transferring the printed sheets 1 from an impression cylinder 6 to an endless chain conveyor 8, which is provided with revolving gripper systems 7 and feeds the sheets in a processing direction indicated by the arrow P across the delivery stack space 4 and then, by opening the gripper systems 7, releases the sheets thereat to form a stack or pile 9 of the sheets 1.

Before printing starts, with the aid of a non-illustrated conventional lifting device, a stack support 10 carrying the stack 9 is conventionally raised to a given production level, so that the first printed sheet 1, after the opening of the gripper system 7 which accepts or takes it over from the impression cylinder 6, comes to rest on the stack support 10, being aligned by leading-edge stops 11 and trailing-edge stops 12. In the course of the production run, the aforementioned non-illustrated lifting device lowers the stack support 10 in such a way that each ensuing sheet 1 is placed substantially at the aforementioned production level on a sheet 1 previously set down there. In the non-stop mode of the production run, just before reaching the lowest possible position of the stack support 10 between a sheet 1, which has already been set down on the stack 9 now grown to the maximum height thereof, and the next sheet in sequence, an auxiliary stack support 13 is placed into an operating position wherein the aforementioned next sheet 1 in sequence, and other sheets 1 following thereafter, are caught from below by the auxiliary stack support 13. In the exemplary embodiment of FIG. 1, this takes place with a horizontal displacement of the auxiliary stack support 13 counter to the processing direction P, the auxiliary stack support 13 being in the form of a rake, with a plurality of straight teeth or tines of the rake disposed parallel to one another and to the legs of a U-shaped frame and rigidly joined to the U-shaped frame at the base thereof, so that the free ends of the tines of the rake act as a cantilevered end 13' of the auxiliary stack support 13. All that is shown of this rake in FIG. 1 is a portion of the tines of the rake, here shown in operating position, which encompasses the cantilevered end 13'. The respective legs of the aforementioned U-shaped frame are guided between two roller pairs 14 spaced apart from one another in longitudinal direction of the tines of the rake, the roller pairs 14 being formed by respective rollers which are disposed above one another, and supported rotatably on a carrier 15. The auxiliary stack support 13 in the form of the rake is thus supported on the carrier 15 in such a way as to be displaceable in and counter to the processing direction. To that end, the carrier 15 of the embodiment shown in FIG. 1 has mutually facing, horizontally oriented parallel frame legs 15.1, respectively, disposed laterally of the stack 9, each of the legs 15.1 carrying one of the aforementioned respective roller pairs 14.

While the auxiliary stack support 13 is in the operating position thereof, the previously formed stack 9 can be removed from the delivery stack space 4, and an empty stack support 10 for receiving another stack be furnished by the aforementioned lifting device. During the time required for this operation, a partial stack of variable weight depending upon the printing speed and the weight of the sheets 1 forms on the auxiliary stack support 13. If the empty stack support 10 is formed with grooves of the kind into which the tines of the rake are lowerable, then the empty stack support 10, after having been suitably raised by the aforementioned lifting device, takes over the partial stack from the tines of the rake of the auxiliary stack support 13, which has remained in the operating position thereof, so that the auxiliary stack support 13 can again be removed from the operating position thereof, and the continuously following sheets 1 then build up the partial stack, which is carried by the now replaced stack support, into a further stack 9.

To maintain the aforementioned production level, the carrier 15 and the auxiliary stack support 13 therewith are lowered, to the same extent that the partial stack increases in height, by a further lifting device which is not shown in complete form in FIG. 1. All that can be seen of this further lifting device in FIG. 1 is a guide profile 16 mounted vertically on the carrier 15 which is disposed vertically displaceably in the delivery 3. In the embodiment illustrated in FIG. 1, for the purpose of vertically guiding the guide profile 16, two roller pairs 17 disposed above one another are supported rotatably on the delivery 3 so that they necessarily guide the guide profile 16 vertically. This type of vertical guidance is provided for each of the frame legs 15.1.

For reliable, positionally correct carrying of the aforementioned partial stack, the cantilevered end 13' of the auxiliary stack support 13, located in the operating position thereof, is supported by a bearing 18 carried by the carrier 15. The bearing 18 is in a functional position wherein it assumes an operating level, i.e., a supporting surface formed on the bearing 18 is disposed in a position wherein the supporting surface contacts the underside of the cantilevered end 13' of the auxiliary stack support 13, while the auxiliary stack support 13 is in the operating position thereof.

The term "operating level" is not meant to be some absolutely defined level, but rather, a level defined with regard to the carrier 15, the absolute height or elevation of that level, in terms of the location thereof, varying to the same extent as does that of the carrier 15, as it is lowered in order to maintain the aforementioned production level during the formation of the aforementioned partial stack.

In the view shown in FIG. 1, the bearing support 18 is in a functional position which is lowered below the operating level. As is explained in detail hereinafter, the bearing 18 is adjustable between the functional position (shown in FIG. 1) which is lowered below the operating level, and the functional position supporting the cantilevered end 13' at the operating level.

Figure 2:
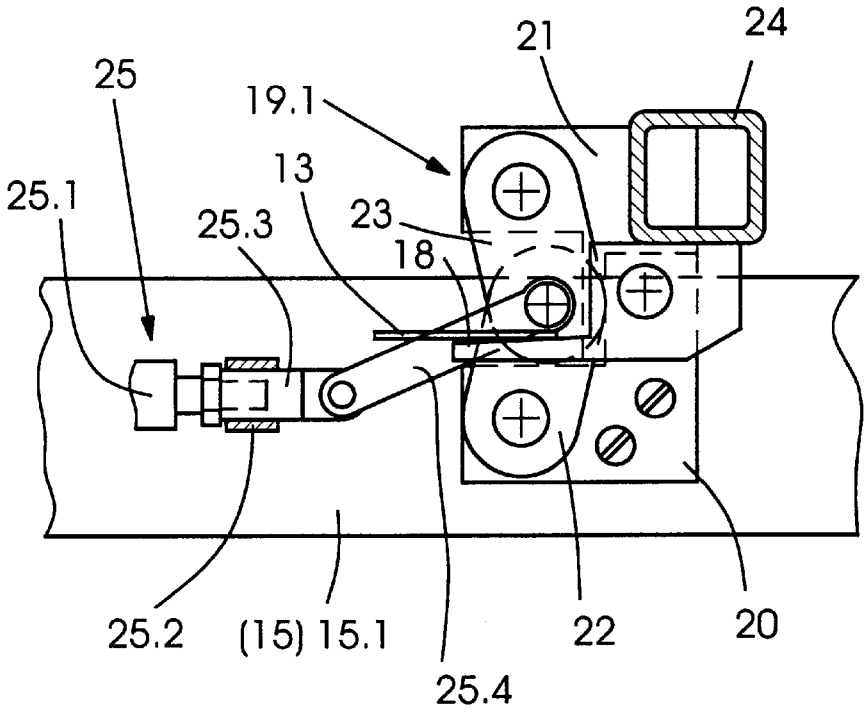
FIG. 2 is an enlarged fragmentary view of FIG. 1, showing details of the device according to the invention.

The exemplary embodiment shown in FIG. 1 for adjusting the bearing 18 between the two functional positions thereof is shown in further detail in FIG. 2 and, unlike FIG. 1, is illustrated in the functional position of the bearing 18 wherein the bearing supports the cantilevered end 13' of the auxiliary stack support 13, when it is in the operating position thereof, at the operating level. This exemplary embodiment provides a linkage or coupling transmission 19.1, which encompasses the bearing 18. Each of the respective two frame legs 15.1 carries connected thereto a frame 20 of the linkage 19.1. A respective first rocker 21 and a respective second rocker 22 are articulatedly connected to the frame 20. Each of these pairs of rockers 21 and 22 is articulatedly connected to a coupler 23. The respective first rockers 21 are also rigidly connected to a crossbar 24 extending crosswise to the frame legs 15.1, and the crossbar 24, in turn, carries the bearing 18. Each of the second rockers 22 and the associated coupler 23 form a respective toggle lever assembly with a toggle, each toggle being engaged by a respective actuator 25, shown here as a crank transmission, by which the respective toggle can be shifted between a first and a second toggle position. The bearing 18 is disposed on the crossbar 24 in a manner that, in each of these toggle positions, it assumes a given one of the functional positions thereof. In the toggle position shown in FIG. 2, the bearing 18 assumes the functional position thereof wherein it supports the cantilevered end 13' of the auxiliary stack support 13 in the operating position thereof, at the operating level. In the other of the two toggle positions, the toggle would be shifted to the lefthand side from where it is shown in FIG. 2, and the bearing which follows the pivoting of the first rocker 21 would have been lowered below the operating level.

The respective actuator 25 in the form of the crank transmission shown includes an adjusting cylinder 25.1, fixedly disposed on the respective frame leg 15.1, with an operative direction oriented in the longitudinal direction of the frame leg 15.1, a piston-rod head 25.3 guided in a longitudinal guide 25.2 carried by the frame leg 15.1, and a crank rod 25.4, which connects the piston-rod head 25.3 pivotally to the toggle of the linkage 19.1. The linkage 19.1 is disposed advantageously so that the toggle lever assembly, in the toggle position wherein the cantilevered end 13' is supported by the bearing 18, assumes a substantially dead center position. It is also possible, by arranging stops for each of the toggle positions, to stress-relieve the actuator 25 in each of the two toggle positions.

Instead of embodying the actuator 25 as a crank transmission, there may also be provided alternatively an adjusting cylinder pivotally disposed on the frame leg 15.1 and having a piston rod head pivotally connected to the toggle of the linkage 19.1.

In the event that the length of the auxiliary stack support 13 in the longitudinal direction of the frame legs 15.1 is such that the cantilevered end 13' in the operating position does not protrude far enough past an edge of the stack support correlated with the cantilevered end 13', then in order to be able to lift the stack support to the abovementioned production level without hindrance from the bearing 18, it is advantageous to dispose the bearing so that it is displaceable in the longitudinal direction of the frame legs 15.1.

This displaceable disposition is utilized by the invention for a refinement of the subject described thus far, wherein adjusting motions of the bearing 18 between the two functional positions thereof are derived from corresponding displacement motions of this same bearing 18.

Figure 3:
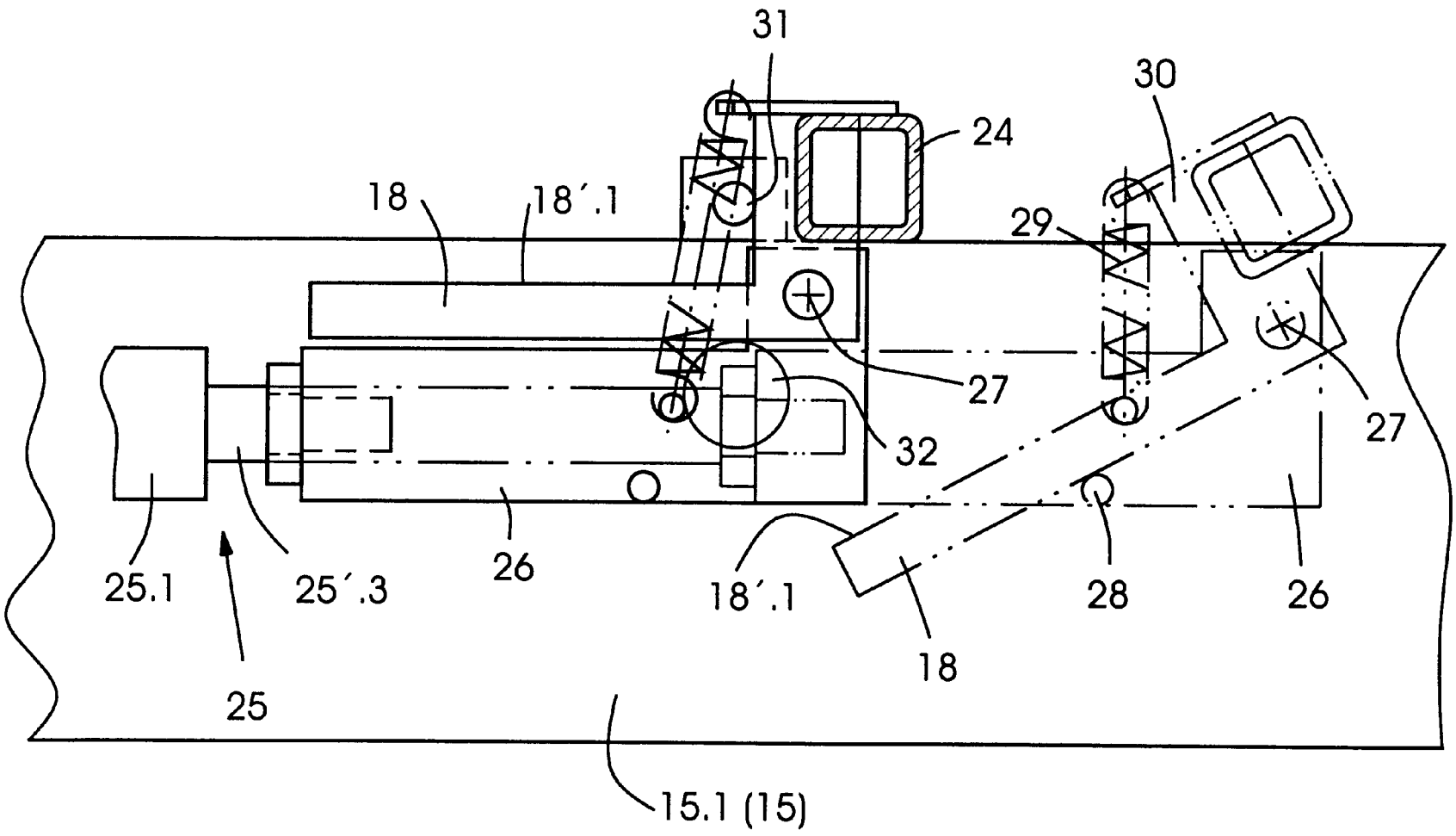
FIG. 3 is a view similar to that of FIG. 2 of another embodiment of the invention, which differs from FIG. 2 particularly with regard to a refinement in the kinematics for adjusting the bearing.

In FIG. 3, in addition to the hereinaforedescribed crossbar 24 which carries the bearing 18', there is shown an arrangement of a further alternative to the aforementioned refinement insofar as it pertains to one of the frame legs 15.1. An analogous arrangement in a mirror-symmetrical construction is provided on the opposite frame leg 15.1. Each of these mirror-symmetrical arrangements includes a respective base 26, which is adjustable between two terminal positions by a displacement of the base 26 in and counter to the processing direction P or, in other words, in the longitudinal direction of the frame legs 15.1. To accomplish this displacement, a positioner assembly 25' is provided which, in the embodiment shown in FIG. 3, is formed by a respective adjusting cylinder 25.1, which has an operative direction oriented in the longitudinal direction of the frame leg 15.1 and has a piston rod head 25'.3 which is firmly connected to the base 25. The adjusting cylinder 25.1 is firmly connected to the frame leg 15.1, so that, all in all, the base 26 is carried by the carrier 15, and the positioner assembly 25' engages the respective base 26.

Between the bearing 18' and the base 25, an articulated connection is provided, which has a horizontal pivot axis 27 oriented crosswise to the frame leg 15.1 and hence crosswise to the processing direction P (note FIG. 1).

In a first position shown in broken lines in FIG. 3, the base 26 is diverted by the adjusting cylinder 25.1 counter to the processing direction P by the cantilevered end 13' of the auxiliary stack support 13 into a first end position. In this position, the bearing 18' assumes a pivoted position relative to the pivot axis 27 so that the former drops away in a direction towards the cantilevered end 13'. The bearing 18' is then lowered, in one of the two functional positions thereof, below the further aforementioned operating level or, in other words, a support surface 18'.1 formed on the bearing 18' is located at a lower level than would be necessary to support the cantilevered end 13' on this support surface 18'.1 at the operating level. This pivoted position is defined by a stop 28 disposed at the base 26, against which the bearing 18' is pressed by a spring 29 acting between it and the base 26.

From the aforementioned first end position, the base 26 can be displaced by the adjusting cylinder 25.1 into a second end position shown in solid lines in FIG. 3. In this regard, in the embodiment of FIG. 3, the piston-rod head 25'.3, which has been projected to the first end position of the base 26, is retracted. Towards the end of this displacement of the base 26, a stop lever 30, formed on the bearing 18' and thus being pivotable relative to the articulated or pivot axis 27, comes into engagement with a stationary further stop 31 so that, at the end of the aforementioned displacement or, in other words, upon reaching the second end position of the base 26, the bearing 18' is pivoted out of the lowered functional position thereof counter to the action of the spring 29 into the functional position wherein it supports the cantilevered end 13' of the auxiliary stack support 13 at the operating level.

In the latter of the two functional positions, the bearing 18' can be locked by an additional stop 32 which, in the embodiment of FIG. 3, is formed as an axially displaceable indexing pin and is adjustable, by a non-illustrated further adjusting cylinder, between a position which releases the bearing 18' and a position which braces or supports the bearing 18' against its being lowered.

In FIG. 4, again in addition to the crossbar 24 which carries the bearing 18, a second alternative to the aforementioned refinement is shown in terms of one of two mirror-symmetrical arrangements, each of which is associated with one of the frame legs 15.1. In this alternative construction, once again, adjusting motions of the bearing 18 between the two functional positions thereof are derived from the advantageously provided displacement motions of the bearing 18 in the longitudinal direction of the frame legs 15.1.

Each of these mirror-symmetrical arrangements includes a base 33 carried by the carrier 15 and adjustable between two end positions in the longitudinal direction of the frame leg 15.1 by a positioner assembly 25' engaging therewith. The positioner assembly 25', analogously to the alternative construction of FIG. 3, includes an adjusting cylinder 25'.1 firmly joined to the frame leg 15.1 and having a piston-rod head 25'.3 firmly joined to the base 33. Between the bearing 18 and the base 33, unlike the alternative construction of FIG. 3, an articulated or pivotable connection with a plurality of horizontal pivot axes oriented crosswise to the frame leg 15.1 is provided, specifically in this case in the form of a linkage 19.2 corresponding to the linkage 19.1 in the embodiment of FIGS. 1 and 2, but wherein the base 33 displaceable in the longitudinal direction of the frame leg 15.1 serves as the frame.

Figure 4:
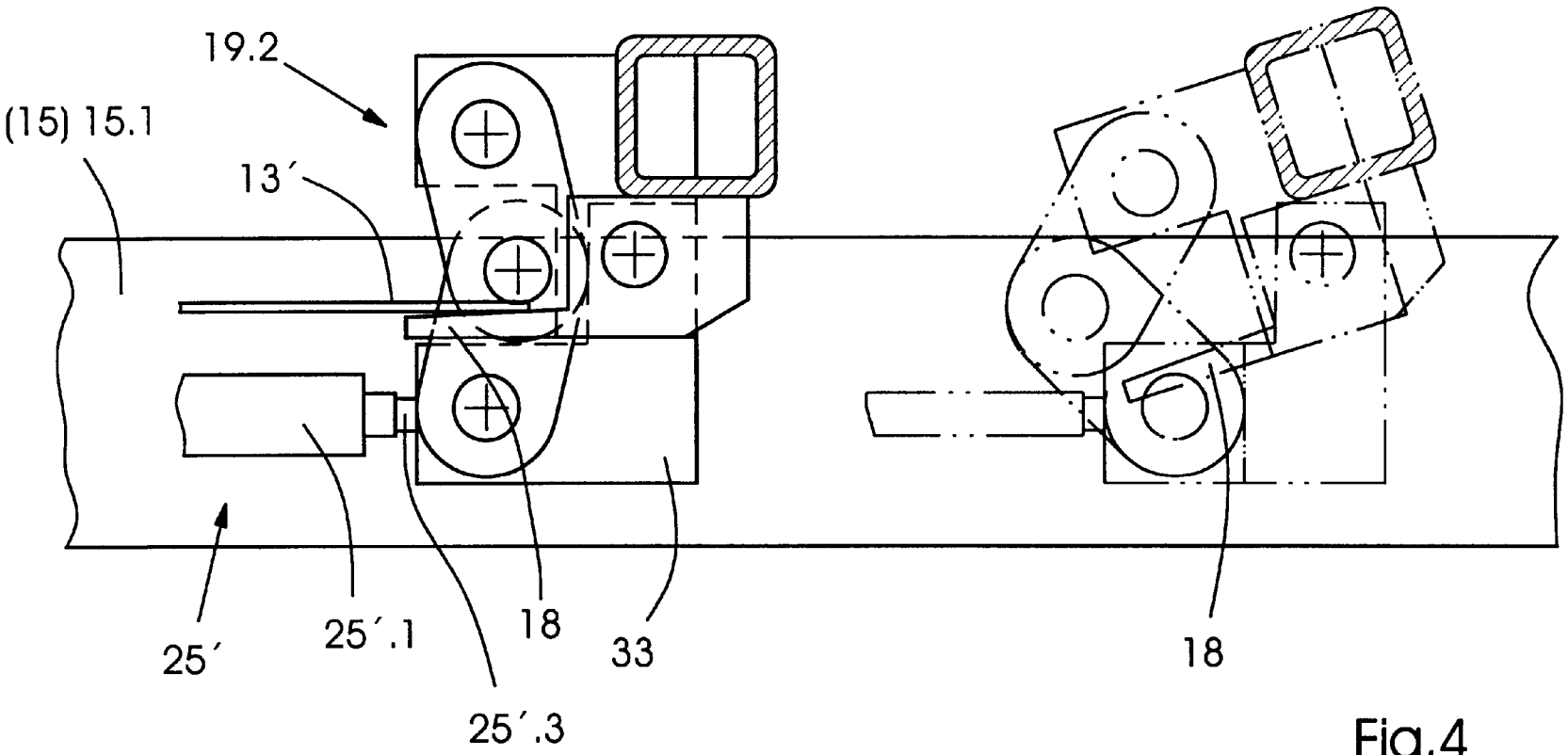
FIG. 4 is a view like that of FIG. 3 of a further embodiment of the kinematically refined device according to the invention.

In a first position represented in phantom in FIG. 4, the base 33 is withdrawn or diverted, analogously to FIG. 3, into a first end position by the cantilevered end 13' of the auxiliary stack support 13. The linkage 19.2 forms a toggle lever assembly corresponding to that of the embodiment of FIGS. 1 and 2, wherein the toggle, before reaching the first end position, strikes a stationary stop, not shown in FIG. 4, so that, beginning at a previously prevailing, virtually dead center position of the toggle lever assembly, the toggle buckles, and thus puts the bearing 18, which was previously at the operating level thereof, into the lowered functional position, thereby adjusting the linkage 19.2.

From the aforementioned first end position, the base 33 can be displaced, analogously to the alternative embodiment of FIG. 3, into a second end position shown in solid lines in FIG. 4. Before reaching this second end position, the toggle of the linkage 19.2 again strikes a further fixed-in-position or stationary stop, not shown in FIG. 4, so that the previously buckled toggle lever assembly changes over to a virtually dead center position. In the embodiment of FIG. 4, a transmission position wherein the dead center position is overshot slightly is approached and, in this transmission position, the toggle lever assembly is held by another stop, not shown in FIG. 4, which engages the toggle and is disposed on the base 33. This other stop prevents any further overshooting of the dead center position, that is, it secures the functional position assumed by the bearing 18 in the second end position of the base 33, the cantilevered end 13' of the auxiliary stack support 13 being supported in that functional position at the operating level.

Figure 5:
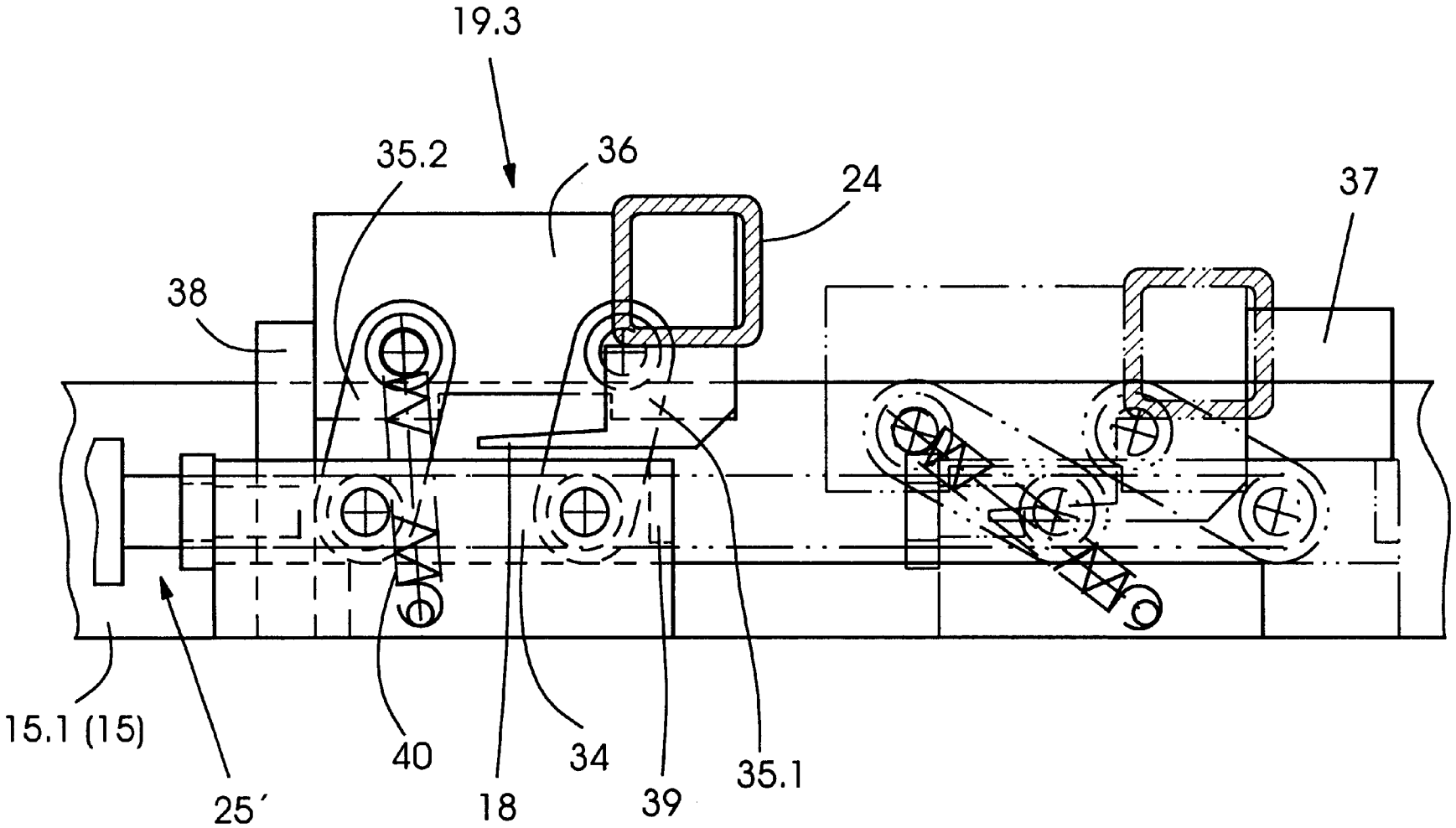
FIG. 5 is a view like those of FIGS. 3 and 4 of yet another embodiment of the kinematically refined device.

In FIG. 5, in a further different construction of the aforementioned refinement wherein adjusting motions of the bearing between the two functional positions thereof are derived from the displacement motions thereof and, once again, in addition to the aforementioned crossbar 24 which carries the bearing 18, the arrangement provided here is shown to the extent that it is associated with one of the frame legs 15.1. As in the previous embodiments, once again there is an analogous mirror-symmetrical arrangement on the opposite frame leg 15.1. Each of these mirror-symmetrical arrangements includes a base 34, which is carried by the carrier 15 and can be adjusted between two end positions analogously to the exemplary embodiment of FIG. 4. Once again, deviating from the alternative construction of FIG. 3, an articulated or pivotable connection with a plurality of horizontal pivot axes, oriented crosswise to the frame leg 15.1, is provided between the bearing 18 and the base 34, specifically in the form of a linkage 19.3, for which the frame is represented by the base 34.

In a position shown in broken lines in FIG. 5, the base 34 is diverted, analogously to the exemplary embodiment of FIG. 4, into a first end position by the cantilevered end 13' of the auxiliary stack support 133. The linkage 19.3 in this exemplary embodiment has two rockers 35.1 and 35.2 which, together with the base 34 and a coupler 36 firmly joined to the crossbar 24, form a parallelogram. Before reaching the first end position, under the influence of the positioner assembly 25' engaging the base 34, the coupler 36 meets a first stationary stop 37, so that the rockers 35.1 and 35.2, beginning at a previously substantially vertical position thereof, execute a tilting motion with regard to the pivot axes provided on the base 34, the tilting motion being directed away from the stop 37, while the base 34 finally approaches the first end position thereof. This tilting motion is stopped the instant the coupler 36 rests on the base 34. In this position of the linkage 19.3, the bearing 18, because of the rigid connection thereof to the crossbar 24, which in turn is rigidly connected to the coupler 36, is lowered from a previously assumed functional position at the operating level to a functional position located therebelow, and in this functional position associated with the first end position, the bearing 18 is supported on the stop 37 and on the base 34, the latter acting in this case as a stop, as well.

From the aforementioned first end position, and analogously to the alternative construction of FIG. 4, the base 34 is displaceble into a second end position shown in solid lines in FIG. 5. Before reaching this second end position, the coupler 36 meets a second stationary stop 38, so that the rockers 35.1 and 35.2, beginning at the tilted position thereof assumed beforehand, pivot relative to the pivot axes provided on the base into a substantially vertical position, while the base 34 finally approaches the second end position thereof. In the exemplary embodiment of FIG. 5 with the second end position, the base 34 reaches a transmission position wherein a vertical position of the rockers 35.1 and 35.2 is slightly overshot, and one of the rockers 35.1 and 35.2 (in this case, the rocker 35.1) is supported, by means of a further stop 39 disposed on the base 34, against further overshooting of the vertical position, that is, the stop 39 protects the functional position assumed by the bearing 18 in the second terminal position of the base 34, in which functional position the cantilevered end 13' of the auxiliary stack support 13 is supported at the operating level.

To stabilize each of the two functional positions of the bearing 18, a tension spring 40 is suspended by one end thereof from the coupler 36 and by the other end thereof from the base 34 so that it acts as a dead center spring with regard to the rockers 35.1 and 35.2 provided in the interest of articulatedly or pivotally connecting the bearing 18 to the base 34.

Figure 7:
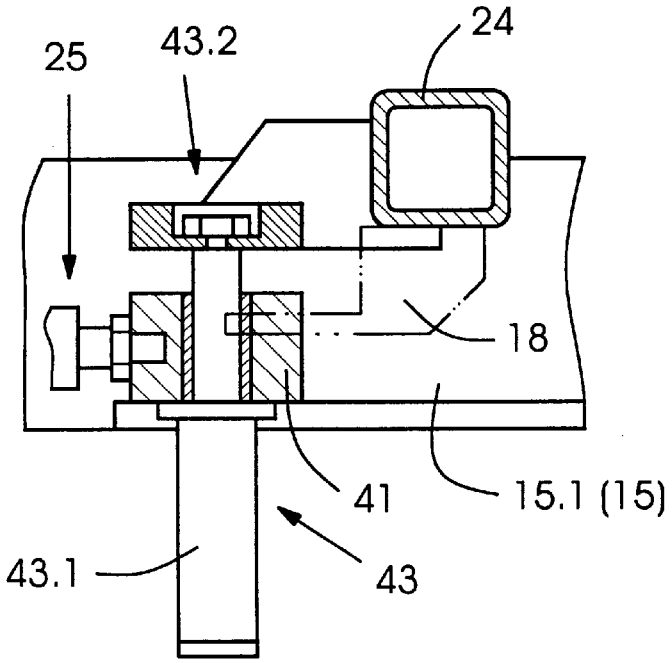
FIGS. 6 and 7 are views like that of FIG. 5 of additional exemplary embodiments of the invention having a base for adjustably receiving the bearing between respective functional positions thereof, the base being carried by the carrier and being displaceable relative thereto in and counter to the processing direction, with various control mechanisms.
Figure 6:
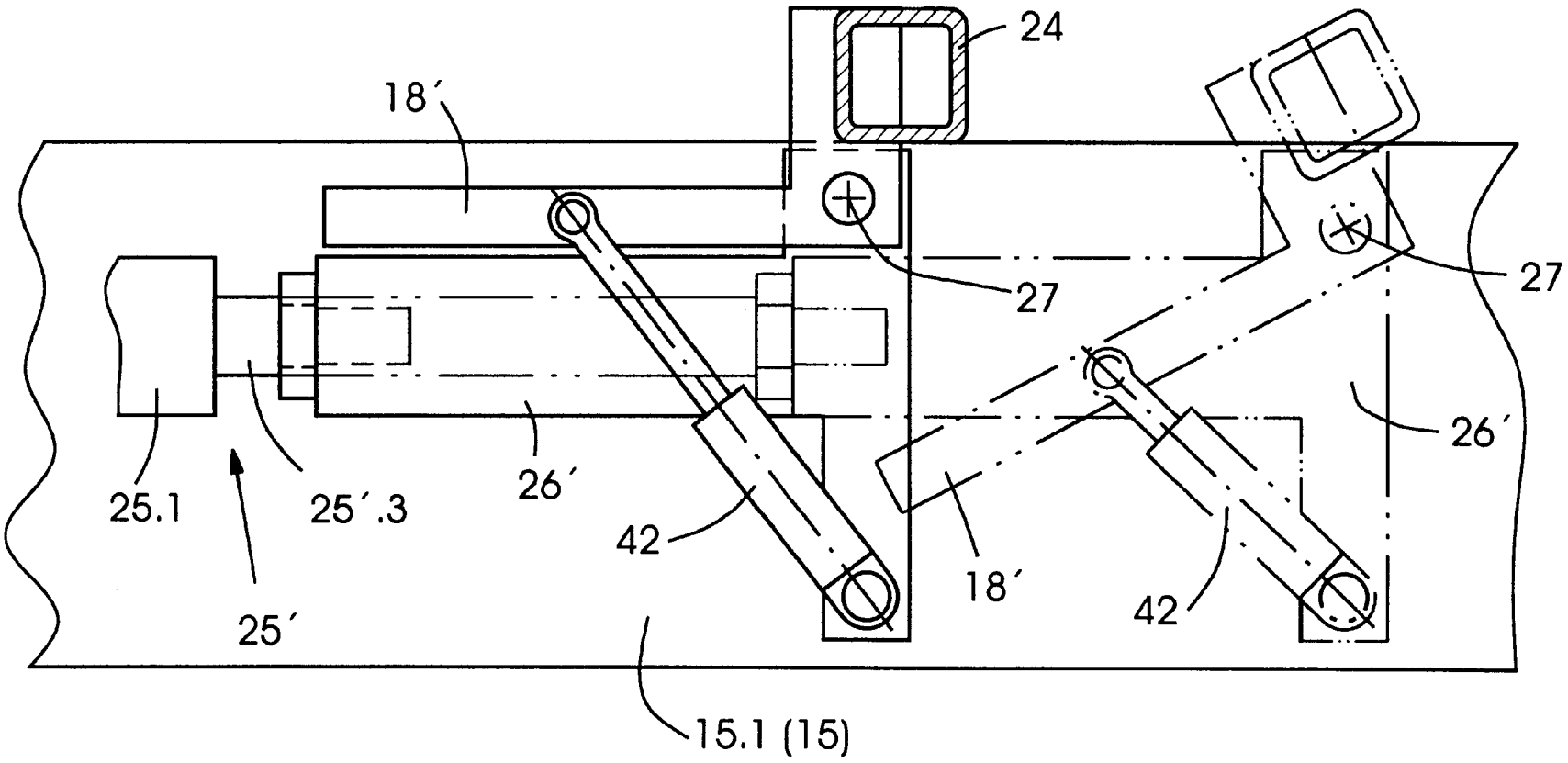

Further exemplary embodiments for receiving the bearing 18, 18' through the intermediary of a base 26', 41 carried by the carrier 15 and displaceable relative thereto in and counter to the processing direction, with an arrangement of the bearing 18, 18' which can be adjusted between two functional positions with regard to the base 26', 41, are shown diagrammatically in FIGS. 6 and 7. Again, together with the crossbar 24 which carries the bearing 18, 18', the foregoing arrangement is provided therein, to the extent that it is associated with one of the frame legs 15.1. As in the exemplary embodiments described above, once again an analogous arrangement is provided, in mirror symmetry, on the opposite frame leg 15.1.

In the embodiment of FIG. 6, for the arrangement of the bearing 18' that can be adjusted between two functional positions as in the example of FIG. 3, once again, an articulated or pivotable connection between the bearing 18' and the base 26, with a horizontal pivot axis 27 directed crosswise to the processing direction, is provided. The adjustment between the two functional positions thereby takes place, deviating from the embodiment of FIG. 3, independently of the course of motion of the base 26' upon the displacement thereof, between the first end position, shown in phantom, and the second end position, shown in solid lines, of the base 26' by the aforementioned positioner assembly 25'. To that end, there is provided a further adjusting cylinder 42 which is operative between the base 26' and the bearing 18' and by which the bearing 18' is pivotable between the two functional positions relative to the pivot axis 27.

Instead of the articulated or pivotable connection between the bearing 18' and the base 26' with the single pivot axis 27 provided here, a pivotable connection with a plurality of pivot axes may also be provided, for example, as in the embodiments of FIGS. 4 and 5.

Given a suitable rigidity of the structural unit formed by the bearing 18' and the crossbar 24, it is possible to dispense with the mirror-symmetrical arrangement of two adjusting cylinders 42, in which case an adjusting cylinder 42 would then be associated with only one of the frame legs 15.1. Triggering of the adjusting cylinder 42 may be effected with terminal switches, for example, which are actuated by the base 26' in a given end position thereof.

In the embodiment of FIG. 7, for the arrangement of the bearing 18 which is adjustable between the two functional positions, a linear lifting device 43 operating on this bearing is provided; it is supported on the base 41, which can be displaced between the aforementioned end positions in and counter to the processing direction relative to the carrier 15. (In FIG. 7, the device is shown in only one of the two end positions.) In the embodiment of FIG. 7, the lifting device 43 includes an adjusting cylinder 43.1 flanged to the base 41 and having a vertical operating direction, and a piston rod head 43.2, which is rigidly joined to a component group including the aforementioned crossbar 24 and the bearing 18 carried thereby.

For displacing the base 41 between the end positions thereof, a positioner assembly 25' supported on the frame leg 15.1 and engaging the base 41 is provided, in the same way as in the exemplary embodiment of FIG. 6.

Although in the exemplary embodiments described thus far, pneumatically or hydraulically actuatable piston/cylinder units have been mentioned for furnishing the adjusting forces for displacing the respective displaceably disposed bases 26, 26', 33, 34, 41 and for adjusting the bearing 18, 18' between the functional positions thereof, it is also possible for suitably acting motor-driven spindle drives to be provided instead.

We claim:

1. A device for manipulating stacks formed of sheets for a rotary printing press by which the sheets are processable in a processing direction in nonstop operation, the device comprising an auxiliary stack support having a cantilevered end and being disposed in an operating position thereof so as to catch the sheets from below, and a carrier carrying the auxiliary stack support so that it is displaceable in and counter to the processing direction, a bearing carried by the carrier for supporting at an operating level the cantilevered end of the auxiliary stack support disposed in the operating position thereof, said bearing being adjustable between a functional position into which it has been lowered below the operating level and a functional position wherein it supports the cantilevered end at the operating level.

2. The device according to claim 1, including a base for adjustably receiving said bearing thereon between said functional positions thereof, said base being displaceable relative to the carrier in and counter to the processing direction between two end positions.

3. The device according to claim 1, including a linkage encompassing said bearing, and an actuator operatively engaging said linkage.

4. The device according to claim 1, including a base for supporting said bearing carried by the carrier and arranged so as to be displaceable relative to the carrier in and counter to the processing direction between two end positions, and an articulated connection of said bearing to said base, said articulated connection having at least one horizontal pivot axis directed crosswise to the processing direction, a positioner assembly engaging said base for displacing said base between said two end positions, and a stop for supporting said bearing in a respective one of said two end positions in a respective one of said two functional positions thereof.

* * * * *